US005132731A

United States Patent [19]

Oda

[11] Patent Number: 5,132,731

[45] Date of Patent: Jul. 21, 1992

[54] IMAGE FORMING APPARATUS HAVING SUCTION MEANS FOR ELIMINATING GAS GENERATED AT A TRANSFER PORTION AND AIRBORNE POWER TONER AROUND DEVELOPING DEVICES

[75] Inventor: Masataka Oda, Toyohashi, Japan

[73] Assignee: Minolta Camera Kabushiki Kaisha, Osaka, Japan

[21] Appl. No.: 629,827

[22] Filed: Dec. 19, 1990

[30] Foreign Application Priority Data

Dec. 21, 1989 [JP] Japan ..... 1-331669

[51] Int. Cl.[5] ..... G03G 21/00

[52] U.S. Cl. ..... 355/215; 355/271; 355/274

[58] Field of Search ..... 355/271, 274, 277, 215, 355/245, 273, 275, 312, 300; 15/1.5; 271/194, 900, 99

[56] References Cited

U.S. PATENT DOCUMENTS

| | | | |
|---|---|---|---|
| 3,777,158 | 12/1973 | Kamogawa et al. | 250/324 |
| 4,017,065 | 4/1977 | Poehlein | 271/194 X |
| 4,202,618 | 5/1980 | Waschk et al. | 219/216 X |
| 4,466,813 | 8/1984 | Avritt et al. | 355/274 X |
| 4,491,313 | 1/1985 | Schoen | 271/194 |
| 4,922,303 | 5/1990 | Takeda et al. | 355/274 |
| 5,028,959 | 7/1991 | Gooray | 355/215 |

FOREIGN PATENT DOCUMENTS

| | | | |
|---|---|---|---|
| 0173779 | 10/1983 | Japan | 355/215 |
| 0032480 | 2/1987 | Japan | 355/215 |
| 0090684 | 4/1987 | Japan | 355/215 |

*Primary Examiner*—A. T. Grimley
*Assistant Examiner*—Thu A. Dang
*Attorney, Agent, or Firm*—Willian Brinks Olds Hofer Gilson & Lione

[57] ABSTRACT

An image forming apparatus including a pair of guide plates below developing units and adjacent to a transfer portion, the transfer portion including a transfer charger and a separating charger each of which has a first slit to form first paths and each of the guide plates having at least one second slit to form a second path. The image forming apparatus further includes a suction fan so as to suck gas generated in the transfer portion through the first paths and atmosphere around developing device through the second path.

12 Claims, 4 Drawing Sheets

IMAGE FORMING APPARATUS HAVING SUCTION MEANS FOR ELIMINATING GAS GENERATED AT A TRANSFER PORTION AND AIRBORNE POWER TONER AROUND DEVELOPING DEVICES

BACKGROUND OF THE INVENTION

1. Field of the Invention

The present invention relates to an image forming apparatus, and more specifically relates to an electrophotographic image forming apparatus used in laser printers and copying machines which form images by developing a toner image on an image bearing member and transferring said toner image to a transfer medium.

2. Description of the Related Art

In electrophotographic type image forming devices an electrostatic latent image is formed on a photoconductive member [a] and said electrostatic latent image is developed with toner so as to form a toner image which is then transferred to a transfer sheet using a transfer charger [b], as shown in FIG. I. The transfer sheet is guided by a pair of top and bottom sheet guides [d] and [e] prior to the aforesaid transfer so as to properly transit the transfer portion.

Transfer charger [b] is charged with the opposite polarity of the toner image by a corona discharge by a corona wire, and the toner image on the image bearing medium [a] is electrostatically attracted onto the transfer sheet so as to be transferred thereby. Ozone and nitrogen oxides ($NO_x$) are produced during the corona discharges of transfer charger [b] and the separation charger [c] disposed immediately anterior to said transfer charger [b], and because said ozone and nitrogen oxides ($NO_x$) emissions produce detrimental effects during image formation the aforesaid transfer charger [b] and separation charger [c] are provided with a shield member [f] having an exhaust orifice [g] through which the aforesaid ozone and nitrogen oxides ($NO_x$) are expelled by means of a suction fan [h].

On the other hand, developing devices [i], which develop the electrostatic latent image formed on the surface of photoconductive member [a], are provided between transfer portion [k] and exposure portion [j] where the aforesaid electrostatic latent image is formed on the surface of photoconductive member [a], and as spacing is a critical factor around the periphery of photoconductive member [a] said developing devices [i] are positioned immediately above pretransfer sheet guides [d] and [e] in the upstream direction of transfer portion [k].

The toner used in the aforesaid developing devices [i] forms an airborne powder cloud which is dispersed outside said developing devices [i]. The previously mentioned sheet guides [d] and [e] are soiled by the escaping airborne powder toner, and the residual toner remaining on said sheet guides soils the transfer sheet. The suction action of the previously described suction fan [h] produces an associated airflow containing the dispersed toner escaping from the developing devices [i] around photoconductive member [a] and around chargers [b] and [c] and the like in the transfer portion. Further, the aforesaid associated airflow draws the atmosphere containing airborne powder toner and the like from around developing devices [i] and draws said atmosphere through the space between photoconductive member [a] and sheet guides [d] and [e].

The previously described draft air is suctioned past chargers [b] and [c] in the transfer portion, and the toner dispersed in said draft air adheres to and soils the corona wires of chargers [b] and [c] in the transfer portion. The aforesaid toner adhesion on the corona wires causing soiling reduces the output of chargers [b] and [c] in the transfer portion only at the soiled parts of said corona wires, thereby reducing transfer efficiency and adversely affecting separation characteristics.

On the other hand, although the suction of the airborne powder toner and dispersed toner can be eliminated from the side of developing devices [i], when the number of developing devices is increased for color coding and/or colorization, it becomes difficult to install the suction means with proper spacing around the developing devices in a compact image forming device, thereby making it difficult to use a suction means.

SUMMARY OF THE INVENTION

A main object of the present invention is to provide a compact image forming apparatus by providing a suction means for eliminating the airborne powder toner generated by the developing devices and which is installable without regard to the position of said developing devices.

A further object of the present invention is to prevent soiling of the chargers in the transfer portion caused by suctioning the airborne powder toner produced in the developing devices through the same path as the ozone and the like generated by the toner discharge in the transfer portion.

A still further object of the present invention is to provide a means to simultaneously eliminate airborne powder toner produced by the developing devices and ozone generated during toner charging in the transfer portion without influencing the transfer portion.

These and other objects of the present invention are accomplished by an electrophotographic image forming apparatus that forms images by developing a toner image on an image bearing member with a developing device and transferring said toner image to a transfer medium with a transfer charger, said electrophotographic image forming apparatus being provided with a pair of guide plates to guide the transfer medium to the transfer portion and which are disposed below the developing device, to wit, adjacent to the transfer portion, first slits arranged on the shield members of the transfer chargers in the transfer portion, second slits arranged on the respective guide plates to form a communicating path connecting the aforesaid top and bottom guide plates, and a suction means arranged beneath and away from the previously mentioned chargers in the transfer portion to suction the airborne powder toner from the periphery of the developing devices through the aforesaid second slits at the same time the gas produced in the transfer portion is suctioned through the aforesaid first slits.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
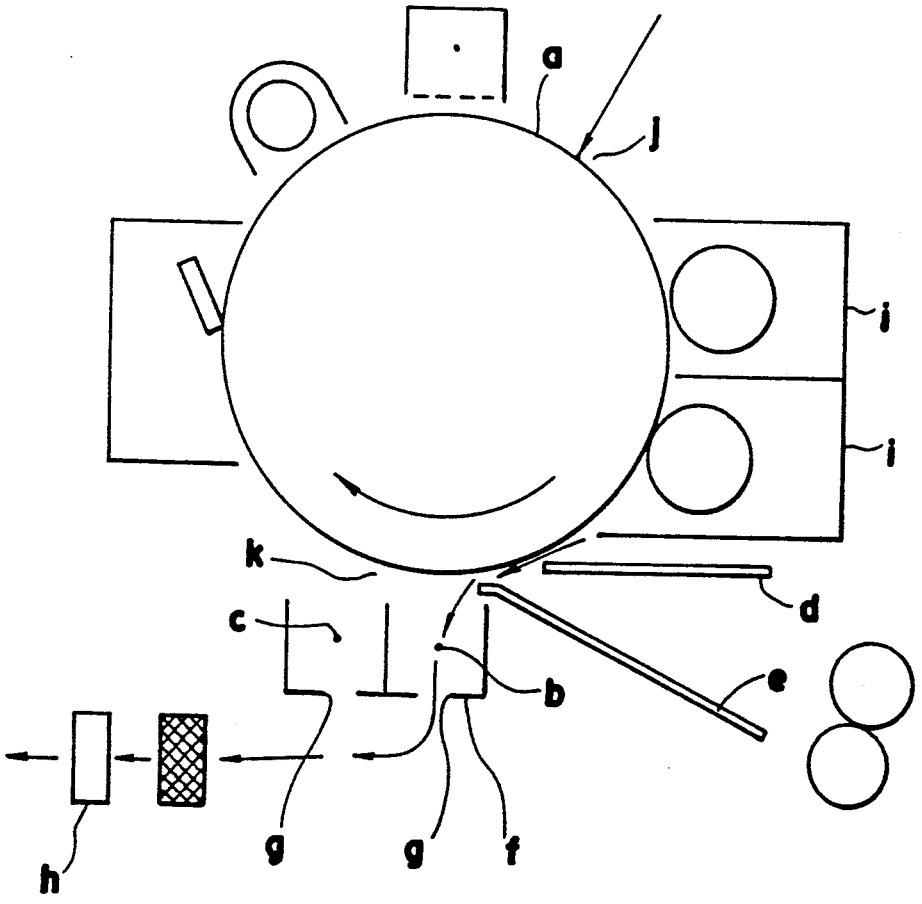
FIG.1 PRIOR ART
FIG. 1 briefly shows the construction of the essential part of a conventional copying machine.
Figure 2:
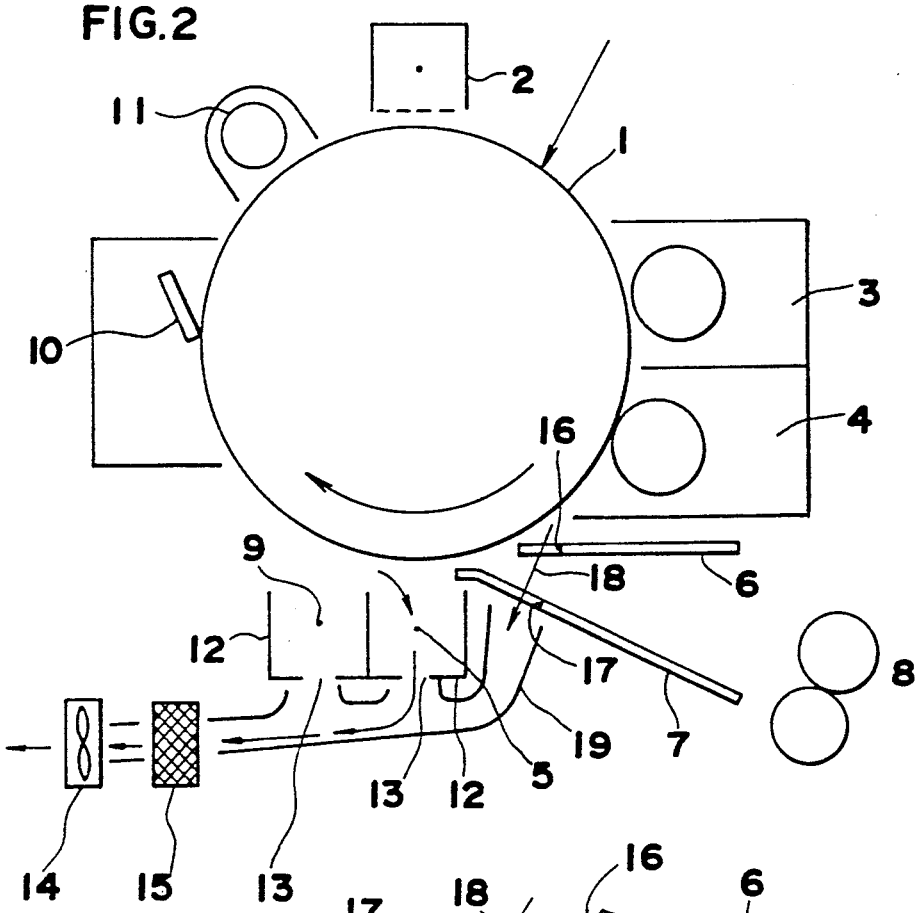
FIG. 2 briefly shows the construction of the essential part of a first embodiment of the copying machine of the present invention.
Figure 3:
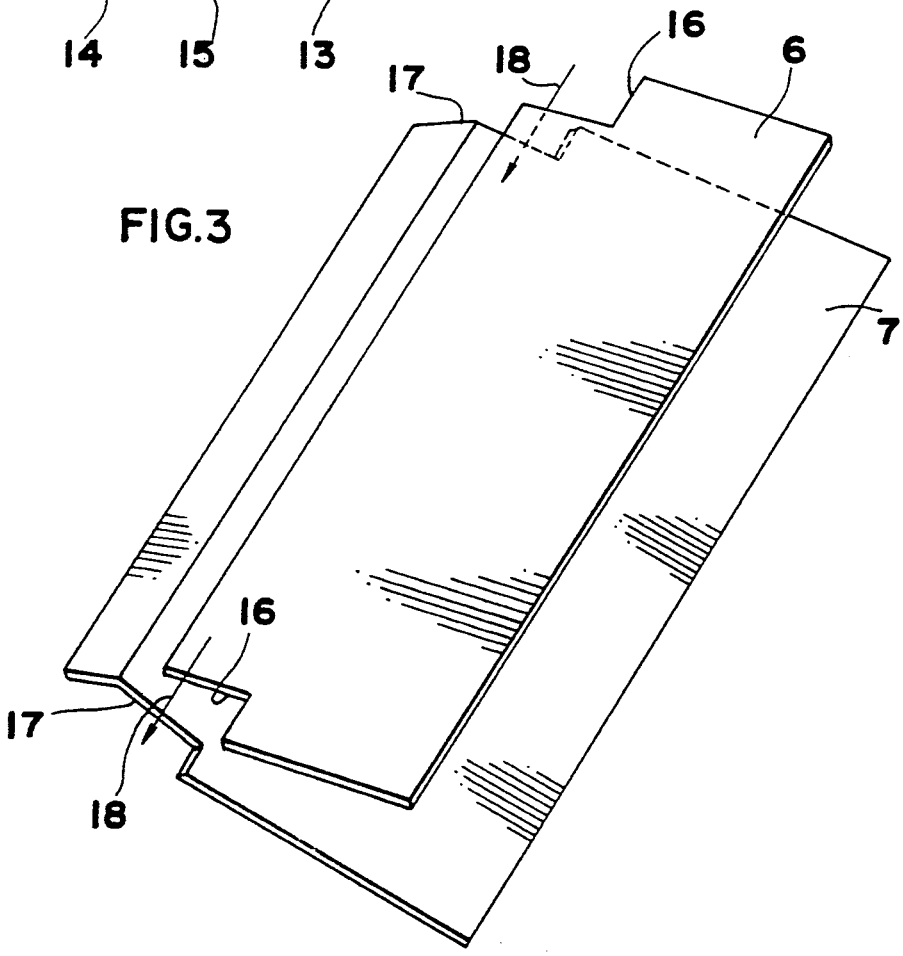
FIG. 3 is a perspective view of the pretransfer guide plates of the first embodiment.

FIGS. 2 and 3 show a first embodiment of the copying machine of the present invention.

In FIG. 2, the surface of photoconductive drum 1 is uniformly charged by charger 2 and exposed to an original document image by an exposure means, not shown in the drawing, so as to form an electrostatic latent image thereon corresponding to said original document image. The aforesaid electrostatic latent image is developed in the desired color by selectively using developing devices 3 and 4, and thereafter is transported to the transfer portion between photoconductive drum 1 and transfer charger 5. A pair of top and bottom pretransfer guides 6 and 7 are provided immediately before the aforesaid transfer portion. Guide plates 6 and 7 guide the transported transfer sheet after said transfer sheet has undergone timing adjustment and anti-skewing adjustment by aligning the leading edge of said transfer sheet with timing roller 8, so as to suitably transport the transfer sheet toward the transfer portion.

Accordingly, in the transfer portion, the developed toner image formed on the surface of photoconductive drum 1 is suitably transferred by transfer charger 5 to the transfer sheet guided thereto. Following the aforesaid toner image transfer, residual toner remaining on the surface of photoconductive drum 1 is removed by cleaner 10, and the residual electric charge remaining on said surface of photoconductive drum 1 is eliminated by eraser 11, then said surface is recharged by charger 2 in preparation for a subsequent exposure.

Air vents 13 are provided in shield members 12 of chargers 5 and 9 in the transfer section, and a suction fan 14 is provided to suction through said air vents the ozone and nitrogen oxides ($NO_x$) produced by the transfer charger 5 and separation charger 9. A filter 15 is disposed on the suction path of the aforesaid fan 14.

On the other hand, slits 16 and 17 are formed in both sides of guide plates 6 and 7 so that the leading edges of said slits are beyond the maximum paper width. Communicating paths 18 connect top and bottom guide plates 6 and 7 by means of the aforesaid slits 16 and 17, and a suction fan 14 is disposed beneath said communicating paths 18 and away from chargers 5 and 9 in the transfer portion. Item 19 in the drawing is a venting duct for the fan operation.

Accordingly, suction fan 14 draws the ozone and nitrogen oxides ($NO_x$) produced by chargers 5 and 9 in the transfer portion through air vents 13, and draws the atmosphere in proximity to developing devices 3 and 4 through communicating paths 18 such that said atmosphere does not pass chargers 5 and 9 in the transfer portion. Thus, even when airborne powder toner is produced by developing devices 3 and 4, said airborne powder toner can be removed by suctioning without affecting chargers 5 and 9 in the transfer portion. Accordingly, the previously described disadvantages of the airborne powder toner from the vicinity of developing devices 3 and 4 adhering to and accumulating on components in proximity to said developing devices 3 and 4, as well as soiling of the transfer sheet directly by overflow toner from said developing devices 3 and 4 are eliminated. Further, the airborne powder toner and overflow toner from developing devices 3 and 4 are not mixed in the suctioned air passing through air vents 13 from chargers 5 and 9 in the transfer portion, thereby eliminating soiling of the corona wires of chargers 5 and 9 in the transfer portion by the aforesaid airborne powder toner and overflow toner.

Dust in the aforesaid suctioned air containing the aforesaid toner and the like is collected by filter 15.

The suction means operating communicating path 18 may, of course, be for an exclusive use of toner removing.

Figure 4:
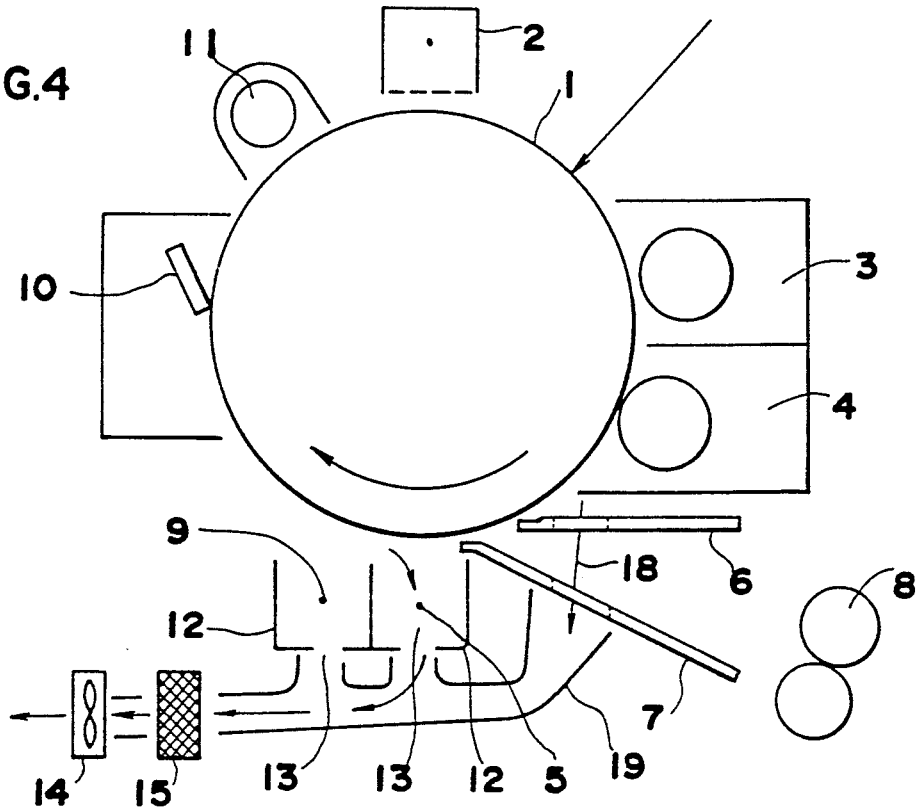
FIG. 4 briefly shows the construction of the essential part of a second embodiment of the copying machine of the present invention.
Figure 5:
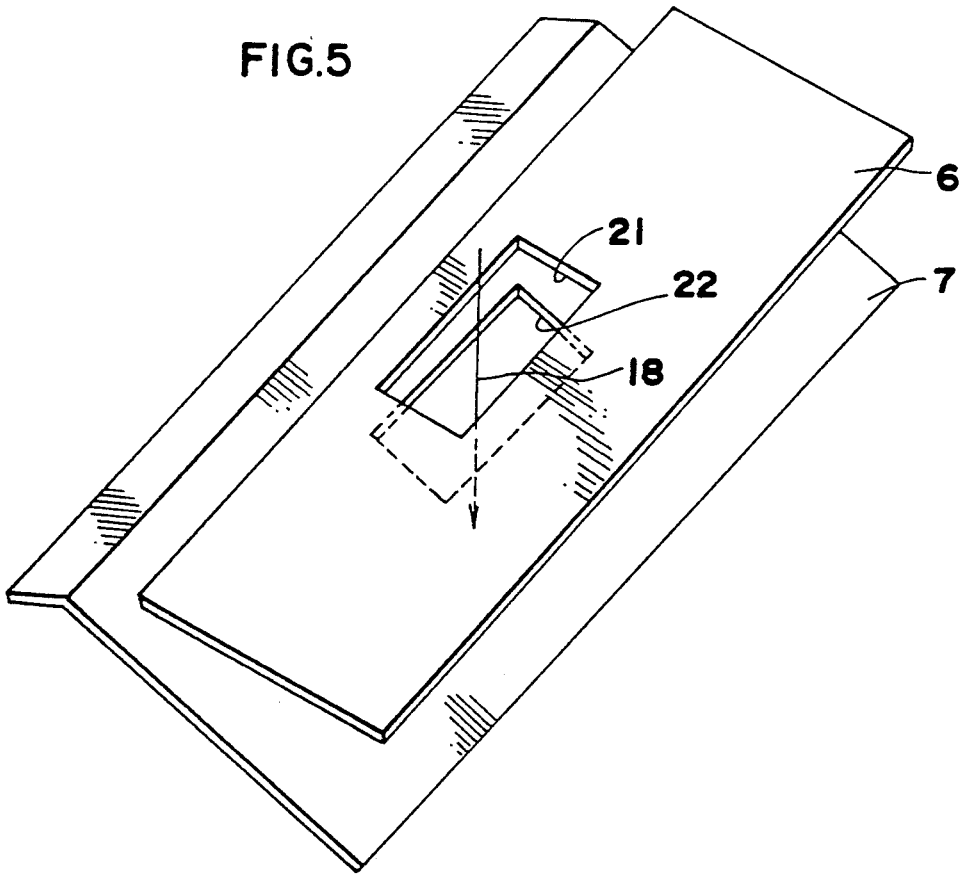
FIG. 5 is a perspective view of the pretransfer guide plates of the second embodiment.

FIGS. 4 and 5 show a second embodiment of the present invention, which differs from the first embodiment only inasmuch as slits 21 and 22 are open in the center portion of the leading edges of guide plates 6 and 7 inside the minimum paper width to form a communicating path 18 for suctioning. The effective action of the second embodiment does not differ from that of the first embodiment.

Slit 21 is positioned within the paper width, and when the atmosphere surrounding developing devices 3 and 4 is drawn through communicating path 18, the toner powder in the suctioned air adheres to slits 21 and 22 and comes into contact with the transported transfer sheet. However, because the transfer sheet rubs slit 21 as it passes thereby each time an image is formed, toner does not remain adhering to said slits 21 and 22, and normally only a very small amount of toner adheres to the transfer sheet, thus there occurs no problem.

Figure 6:
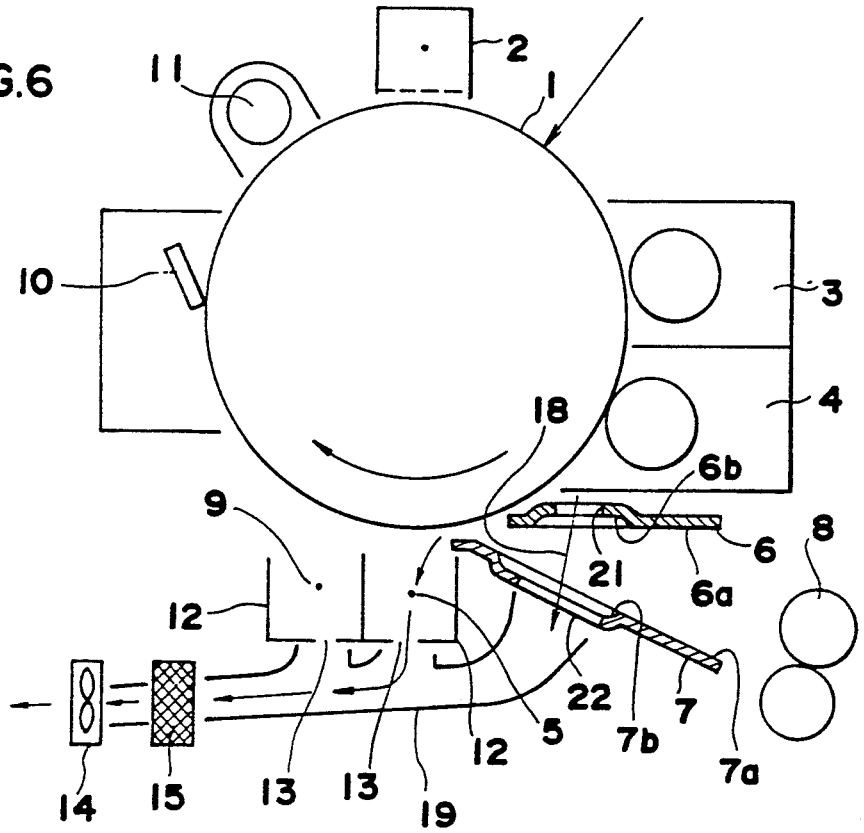
FIG. 6 briefly shows the construction of the essential part of a third embodiment of the copying machine of the present invention.
Figure 7:
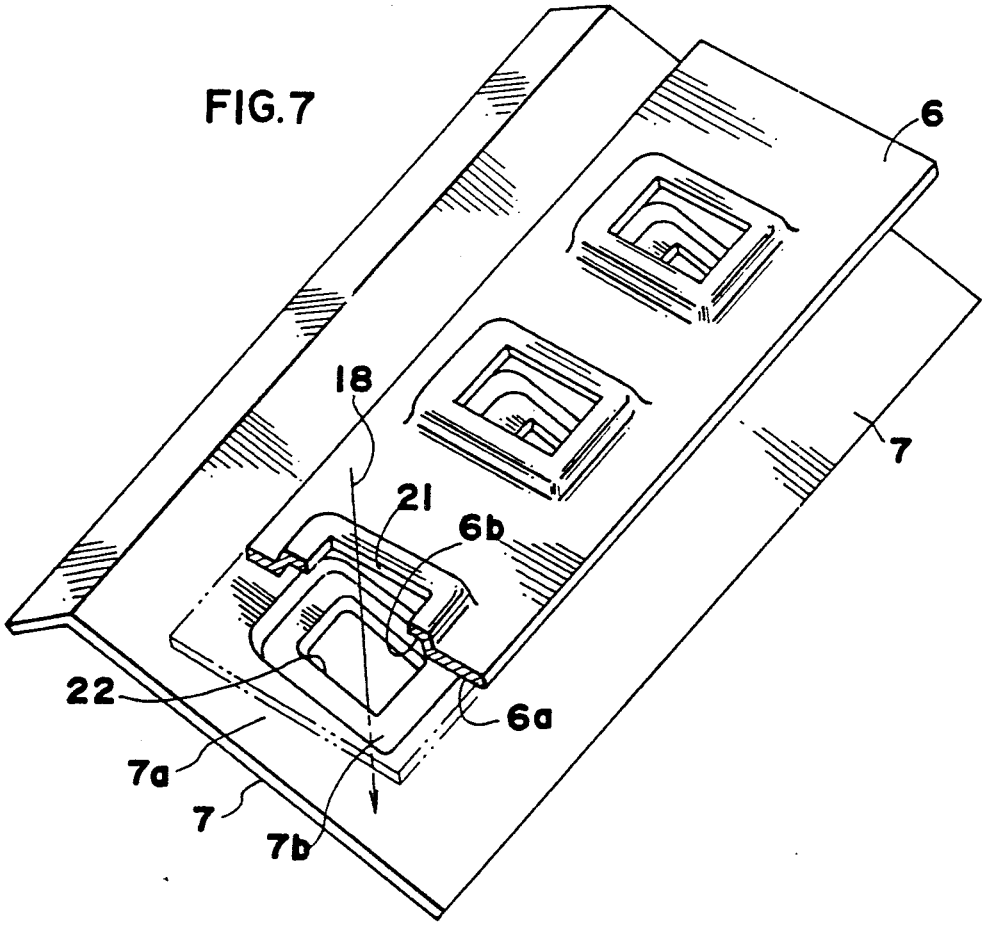
FIG. 7 is a perspective view of the pretransfer guide plates of the third embodiment.

FIGS. 6 and 7 shows a third embodiment of the present invention, which differs from the second embodiment only inasmuch as said slits 21 and 22 are formed in the bottom portion of recesses **6*b* and 7*b* formed by sheet metal processing of surfaces 6*a* and 7*a* of guide plates 6 and 7. Slit 21 is formed so as to be smaller than slit 22**.

In the present embodiment, slits 21 and 22 are formed in the bottom portion of recesses **6*b* and 7*b* of surfaces 6*a* and 7*a* of guide plates 6 and 7, so with adhered toner even when toner in the suctioned air adheres to the periphery of slits 21 and 22. And the toner adhering to the periphery of slits 21 and 22** is normally exposed to the previously described suctioning action so as not to accumulate, thus the transfer sheet is not soiled by said adhered toner.

Further, since slit 21 is smaller than slit 22, the toner adheres to the upper side of slit 21 so as to not soil the transfer sheet.

In the second and third embodiments, the suctioning action passing through communicating path 18, which is positioned within the minimum paper width, is only moderate so that the transfer sheet is not forced onto bottom guide plate 7 and the passage of said sheet is not prevented. In the unlikely event of such a concern, a recessed channel which extends from the opening of slit 22 to outside of the maximum paper width may be provided in guide surface 7a of guide plate 7 so as to form an air venting portion to prevent the adherence of the transfer sheet to the guide plate.

In the present invention a suctioning means below and away from the chargers in the transfer portion operates to a communicating path provided so as to connect the top and bottom pretransfer guide plates, and draws away the airborne powder toner and overflow toner produced in the developing devices which is positioned above said guide plates in such a way that the suctioning means may be installed without regard to the installation spacing of the developing devices, and soiling of the transfer medium by airborne powder toner and overflow toner as well as soiling of the corona wires of the chargers in the transfer portion by the suctioned ozone airflow from the chargers in the transfer portion are prevented.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

developing means facing a photoconductive member for developing an electrostatic latent image which is formed by an exposure means onto the photoconductive member;

a transfer member path provided downstream of said developing means with respect to a rotational direction of the photoconductive member;

charging means facing the photoconductive member and provided adjacent said transfer member path; and suction means for sucking gas generated in said charging means through a first path, and for sucking atmosphere around said developing means through a second path which is formed to pass through said transfer member path;

wherein said charging means has at least one first slit so as to form said first path, and said transfer member path has an upper guide member and a lower guide member through which transfer members are guided to the photoconductive member, and wherein each of said upper and lower guide members has at least one second slit so as to form said second path.

2. The image forming apparatus as claimed in claim 1, wherein said at least one second slit comprises a plurality of second slits on both sides of said upper and lower guide members, respectively, and outside a maximum width of a transfer member.

3. The image forming apparatus as claimed in claim 1, wherein said upper and lower guide members each have the at least one second slit at a center of a leading edge thereof and of a minimum transfer member width.

4. The image forming apparatus as claimed in claim 1, wherein the at least one second slit of each of said upper and lower guide members are so formed as to provide recesses in a periphery thereof.

5. The image forming apparatus as claimed in claim 4, wherein the at least one second slit provided on the upper guide member is smaller than the at least one second slit provided on the lower guide member.

6. The image forming apparatus as claimed in claim 1, wherein said suction means includes a suction fan and a duct which is connected to said first path and said second path to guide the sucked atmosphere and gas therethrough.

7. An image forming apparatus comprising:

developing means facing a photoconductive member for developing an electrostatic latent image formed by an exposure means onto the photoconductive member;

transfer means provided downstream of said developing means with respect to a rotational direction of the photoconductive member for transferring an image developed by said developing means onto a transfer member, said transfer means having at least one first slit;

guide means provided between said developing means and said transfer means for guiding the transfer member to said transfer means, said guide means including an upper guide member and a lower guide member each of which has at least one second slit; and suction means provided below said transfer means for sucking gas generated at said transfer means through said at least one first slit, and for sucking atmosphere around said developing device through said at least one second slit.

8. The image forming apparatus as claimed in claim 7, wherein said at least one second slit comprises a plurality of second slits on each of said upper and lower guide members on both sides thereof and outside a maximum width of a transfer member.

9. The image forming apparatus as claimed in claim 7, wherein each of said upper and lower guide members have said at least one second slit at a center of a leading edge thereof and of a minimum transfer member width.

10. The image forming apparatus as claimed in claim 7, wherein each of said at least one second slit are so formed to provide recesses in a periphery thereof.

11. The image forming apparatus as claimed in claim 11, wherein the at least one second slit provided on the upper guide member is smaller than the at least one second slit provided on the lower guide member.

12. An image forming apparatus comprising:

a photoconductive member;

a developing means facing said photoconductive member for developing an electrostatic latent image which is formed by an exposure means onto the photoconductive member;

a transfer portion provided downstream of said developing means with respect to a rotational direction of the photoconductive member for transferring an image developed by said developing means onto a transfer member, said transfer portion including chargers each of which has a second slit.

a transfer member path provided below said developing means and adjacent to said transfer portion for guiding the transfer member to said transfer portion, said transfer member path including a couple of guide members each of which has at least one second slit;

suction means provided below said transfer portion for sucking gas generated at said transfer means through said first slit and for sucking atmosphere around said developing device through said at least one second slit; and guide means for guiding the gas from the first slit and the atmosphere from the at least one second slit to said suction means.

* * * * *

UNITED STATES PATENT AND TRADEMARK OFFICE

CERTIFICATE OF CORRECTION

PATENT NO. : 5,132,731

DATED : July 21, 1992

INVENTOR(S) : Masataka Oda

It is certified that error appears in the above-identified patent and that said Letters Patent is hereby corrected as shown below:

In Col. 4, line 52, after "so", insert --that the transfer sheet does not come into contact--.

In Col. 6, line 40 (Claim 11, line 2), change "11" to --10--.

Signed and Sealed this

Fourteenth Day of September, 1993

*Attest:*

*Attesting Officer*

BRUCE LEHMAN

*Commissioner of Patents and Trademarks*